US005314046A

United States Patent [19]

Pedrini

[11] Patent Number: 5,314,046

[45] Date of Patent: May 24, 1994

[54] EXPANDABLE CONTAINER WITH INTERNAL MANUAL OPERATION SYSTEM

[76] Inventor: Fabio Pedrini, via Zamboni no. 1, Bologna, Italy

[21] Appl. No.: 850,514

[22] Filed: Mar. 13, 1992

[30] Foreign Application Priority Data

Mar. 15, 1991 [IT] Italy ..... B091A000082

[51] Int. Cl.[5] ..... A45C 7/00

[52] U.S. Cl. ..... 190/105; 190/15 R; 190/22; 220/8; 220/436

[58] Field of Search ..... 220/8, 4.03, 435, 436, 220/464, 468, 469; 190/103, 104, 105, 22, 15 R

[56] References Cited

U.S. PATENT DOCUMENTS

| | | | |
|---|---|---|---|
| 281,268 | 7/1883 | Haskell | 190/105 |
| 672,143 | 4/1901 | Boughner | 190/105 X |
| 698,488 | 4/1902 | Gilbert | 190/104 |
| 701,440 | 6/1902 | Wilkinson | 190/105 |
| 712,762 | 11/1902 | Bukoutz | 190/105 |
| 805,680 | 11/1905 | Sprague | 190/105 |
| 888,554 | 5/1908 | Tuttle | 220/436 X |
| 1,120,955 | 12/1914 | Martin | 220/8 X |
| 1,241,210 | 9/1917 | Harvey | 190/104 |
| 1,708,829 | 4/1929 | Cheney | 190/105 X |
| 4,624,382 | 11/1986 | Tontarelli | 220/8 |
| 4,630,717 | 12/1986 | Tong | 190/104 |
| 4,787,488 | 11/1988 | Campanini | 190/22 X |
| 4,844,215 | 7/1989 | Ambasz | 190/105 |
| 4,846,319 | 7/1989 | Saaow | 190/105 |
| 4,854,430 | 8/1989 | Peterson | 190/105 |

FOREIGN PATENT DOCUMENTS

| | | | |
|---|---|---|---|
| 339368 | 10/1919 | Fed. Rep. of Germany | 190/22 |
| 498303 | 7/1927 | Fed. Rep. of Germany | 190/22 |
| 11502 | of 1911 | United Kingdom | 190/22 |

*Primary Examiner*—Allan N. Shoap
*Assistant Examiner*—Stephen Cronin
*Attorney, Agent, or Firm*—Richard M. Goldberg

[57] ABSTRACT

Expandable container consisting of two hollow bodies, the inner one fitting inside the outer body and bearing a closed bottom. Placed between these two bodies is a harmonic steel band; the said band bears diagonal slots which are engaged by pins integral with the shell of the hollow inner body. The steel band can slide freely and is moved by a hand-operated knob.

8 Claims, 3 Drawing Sheets

EXPANDABLE CONTAINER WITH INTERNAL MANUAL OPERATION SYSTEM

BACKGROUND OF THE INVENTION

Expandable container consisting of two hollow bodies, one of which fits inside the other, the inner one being provided with a closed bottom. Placed between these two bodies, which should ideally be made from thermoformed or injection moulded plastic, is a closed band made, for example, from harmonic steel sheet, contained within the outer body by means of two retaining rims made in its outer edges; the steel sheet bears angled slots engaged by pins integral with the shell of the inner body. The steel band can slide freely inside the two retaining rims, moved by a knob integral with it and operated by hand; the movement of the band forces the hollow inner body to extend outwards from the hollow outer body or to return inside it. A lid, hinged to the hollow outer body, closes the container.

PRIOR ART

It is known that there currently exist expandable containers in which the movement between the two bodies making up the main container is achieved by the use of levers or sliding joints placed at the four corners and of the screw-nut screw type; these mechanisms are operated by toothed belts, flexible cables or other similar devices.

In all these cases the rigid elements controlling the movement between the two containers are located at the four corners and operated by other flexible systems connected with them in various ways. It is accordingly clear that these systems ensure proper movement only if they are made with great precision and fitted with great accuracy; as a result, they are expensive and difficult to introduce on automated assembly systems.

Moreover, since the connection between the two hollow bodies is achieved only at the four corners, the overall rigidity of the structure becomes unacceptable when the said bodies are made using flexible materials such as thermoplastics.

FIELD OF THE INVENTION

The purpose of this invention is to create an expandable container without the problems mentioned above, which can be assembled on automated systems and whose characteristics include ease of assembly, great rigidity and reliability and knock resistance, as well as low cost if made from plastic.

These aims are achieved by making the two hollow bodies so that the outside edges of the outer body fold onto themselves so as to form a rim inside which a very thin harmonic steel band is placed; the band is a closed ring and its surface bears a suitable number of angled slots parallel with each other.

The hollow inner body bears on its outside face a series of projecting pins, each of which engages its corresponding slot in the steel band; in this way a connection is achieved between the two hollow bodies over the whole of the two inner faces, conferring excellent rigidity on the entire structure. A knob is fixed to the upper inside edge of the steel band and serves to move the band manually to the right or the left; the movement of the steel band, which runs freely inside the rim formed in the fixed hollow outer body, determines the movement of the pins engaging the slots in the steel band and integral with the hollow inner body which, as a result, moves under the action of the band.

The device designed in this way allows both the movement control system and the expansion elements situated between the two bodies to be concentrated in just one element, the steel band, with attendant advantages in simplicity, reliability, cost convenience and speed of assembly. In addition, the steel band, being a closed loop, has high stress resistance without losing flexibility, thus helping to stiffen the structure of the two hollow bodies which, as a result, will withstand considerable compression and knock stress.

Lastly, the thinness of the steel band, amounting to several tenths of a millimetre, ensures that the overall thickness of the wall is also very limited in comparison with the solutions designed to date, thus increasing the volume available inside the container. Other aims and advantages will be apparent from the following description and from the attached drawings which illustrate, in schematic form and by way of example, one way of realizing the invention.

BRIEF DESCRIPTION OF THE DRAWINGS

With reference to the said drawings.

DETAILED DESCRIPTION OF THE INVENTION

Figure 1:
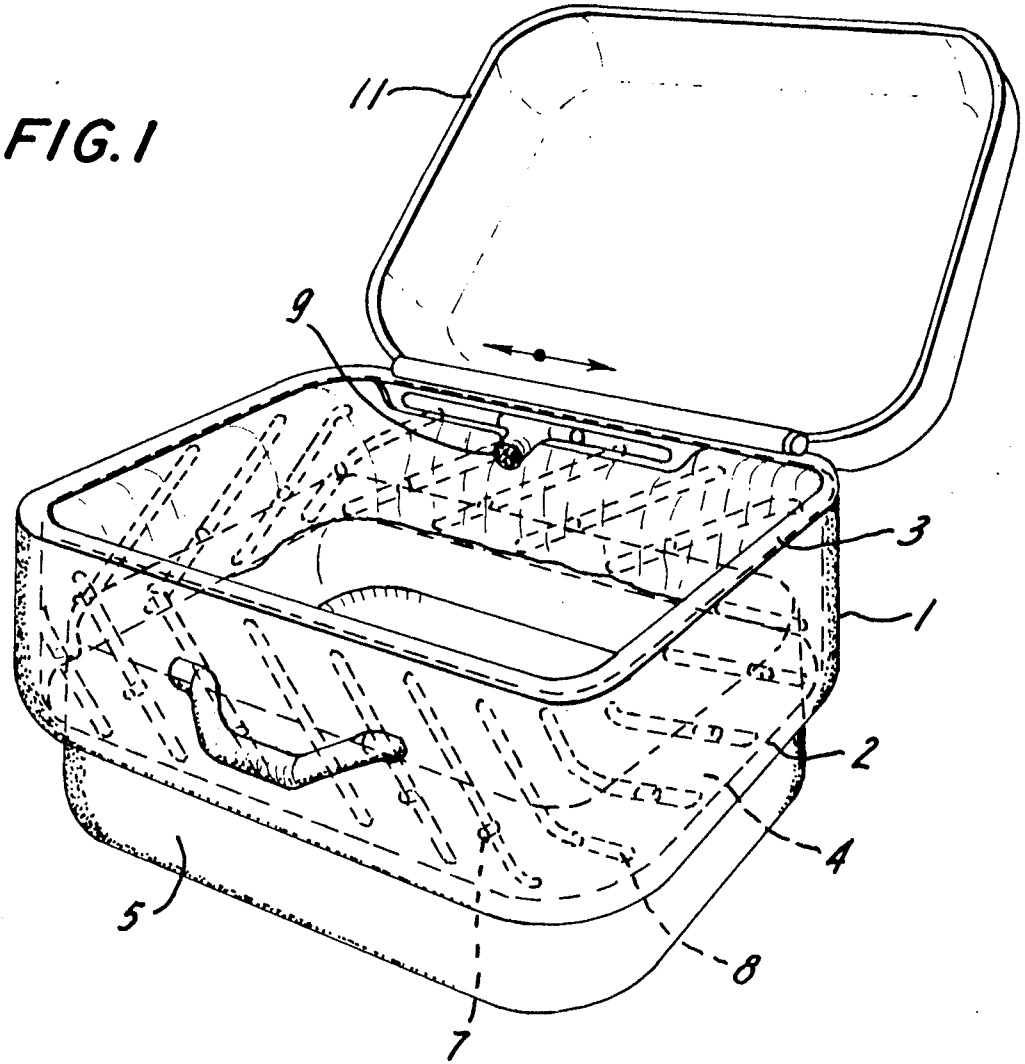
FIG. 1 is a perspective view of the container built in the form of a suitcase.
Figure 2:
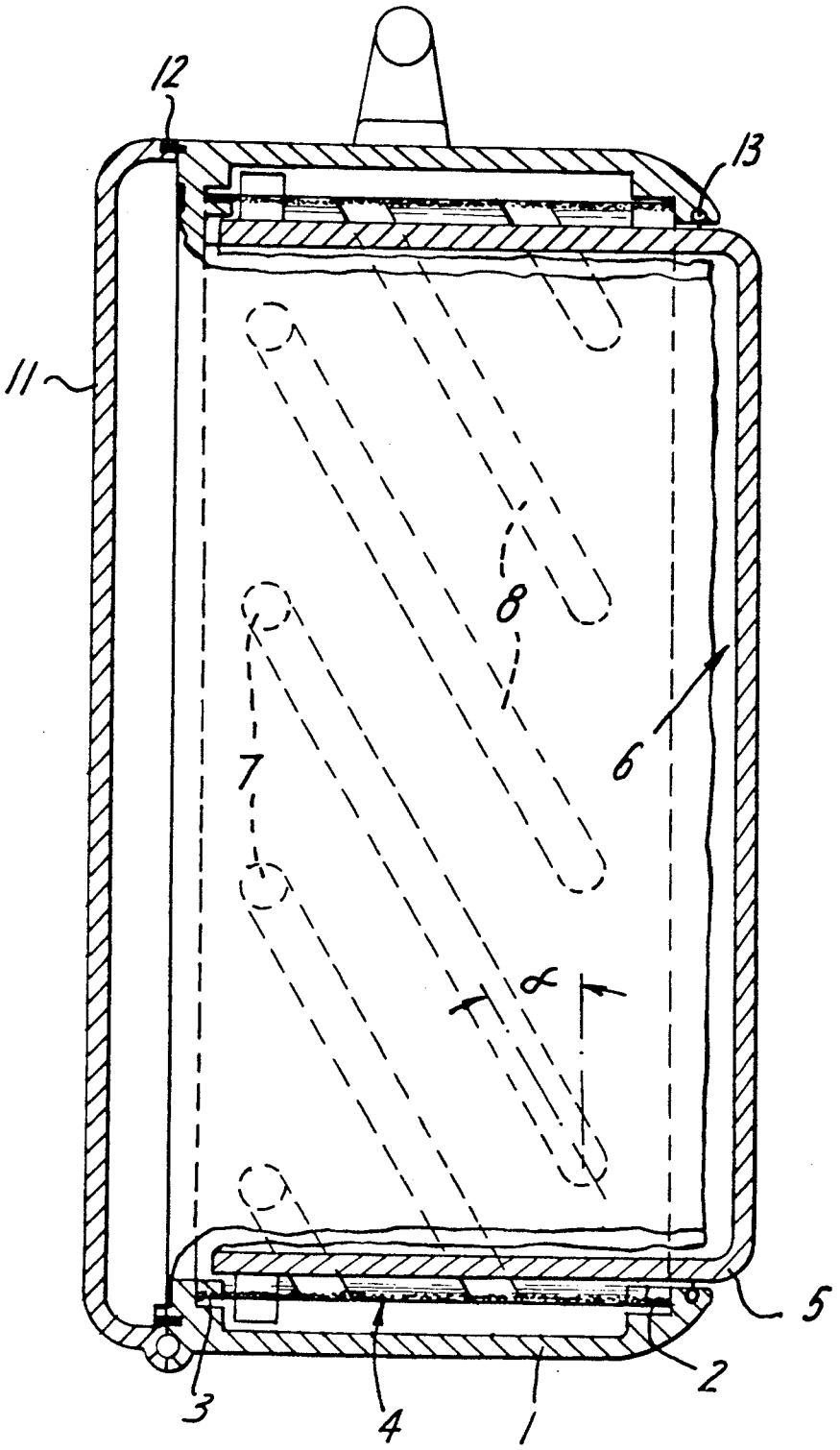
FIG. 2 is a sectional view of the same container in its closed, minimum volume configuration.
Figure 3:
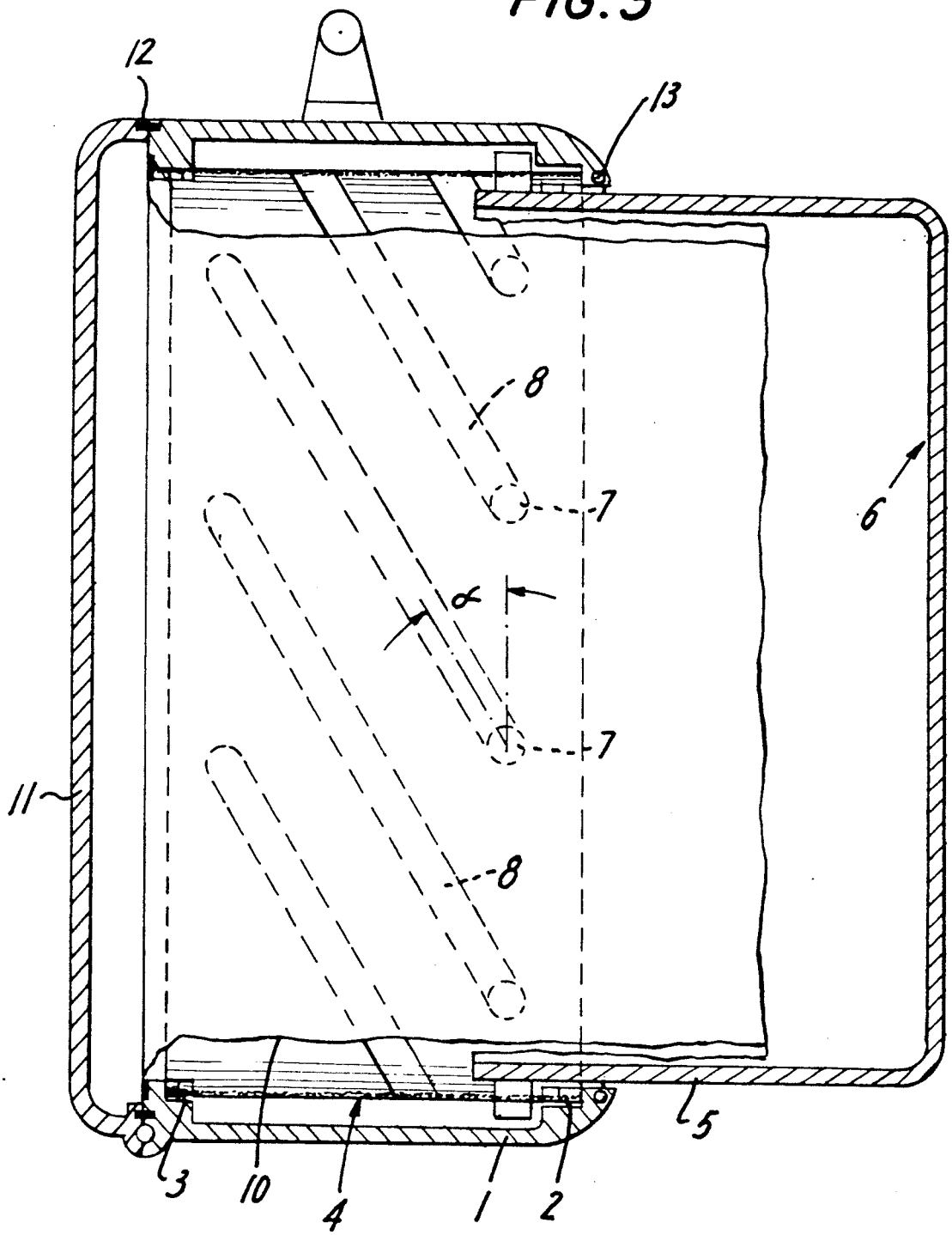
FIG. 3 is a sectional view of the container in its open, maximum volume configuration.

The container consists basically of an outer body 1, which is hollow and without bottoms and whose outside edges 2 and 3 are bent in a U-shape so as to form a rim; contained inside this rim is a band 4, in harmonic steel and in the form of a closed loop, which slides inside the said rim. The steel band 4 bears a series of slots 8 over its whole surface; these slots are parallel to each other and set at an appropriate pre-established angle a.

A second body 5, also hollow inside but provided with a closed bottom 6, bears on the surface in contact with the band 4 a series of projecting pins 7 which engage the corresponding slots 8 in the steel band; the diameter of the pins 7 is slightly smaller than the thickness of the slots 8 so that they can slide freely inside them.

The container is opened or closed by moving the band 4 with the knob 9, which is fixed to the said band 4 and projects inside the container. To prevent interference between the contents and the steel band 4, a lining 10 is envisaged, secured to the edge of the body 1, which covers the inside of the container.

Also included is a lid 11, hinged to the container at the upper edge of the body 1 and fitted with a seal 12 to prevent infiltration by foreign bodies from the outside. A second seal 13 is placed between the body 1 and the body 5, being introduced in a suitable seat made in the hollow body 1, and it performs the same function as the seal 12.

This invention, as illustrated and described here by way of example, may be extended to all those secondary variants which, as such, fall within its scope.

I claim:

1. An expandable container with an internal manual operating system, comprising:

a hollow outer body with a substantially parallelepiped cross-sectional configuration;

a hollow inner body that fits inside the outer body;

an annular band connected in sliding relation within said outer body and placed between the inner and outer hollow bodies, said annular band including at least one angled slot;

pin means connected with said hollow inner body for engaging with said at least one angled slot;

moving means connected with said annular band for sliding said annular band within said hollow outer body to cause said container to expand and contract; and a lid hinged to the outer body to close the container.

2. An expandable container as described in claim 1, wherein the hollow outer body includes an outside wall with an open bottom and outside edges which are bent inwardly to form a rim at each said outside edge.

3. An expandable container as described in claim 2, wherein said annular band is placed inside the rims and can slide freely inside said outer body, said at least one angled slot including a series of diagonal slots, all of said slots being parallel with each other.

4. An expandable container as described in claim 3, wherein the annular band includes an inner surface and said moving means includes a manual operating knob fixed on the inner surface of the annular band.

5. An expandable container as described in claim 3, wherein said hollow inner body includes a closed bottom, an outside face and said pin means includes a series of projecting pins on the outside face which engage in corresponding slots in the annular band.

6. An expandable container as described in claim 1, further including interior seal means for providing a seal between said outer body and said inner body and between said outer body and said lid; and a lining positioned in covering relation to said inner body.

7. An expandable container as described in claim 6, wherein said seal means includes a seal placed between the hollow outer body and the lid, and a seal placed between the hollow inner body and the hollow outer body, to prevent foreign elements from entering said container.

8. An expandable container according to claim 1, wherein said annular band is a closed annular band made from a thin harmonic steel sheet.

* * * * *